United States Patent [19]

Haftmann et al.

[11] Patent Number: 4,955,737

[45] Date of Patent: Sep. 11, 1990

[54] HOLDER FOR A RIBBON FOR TYPEWRITERS OR SIMILAR MACHINES

[75] Inventors: Johannes Haftmann, Schwabach; Werner Haczek, Furth, both of Fed. Rep. of Germany

[73] Assignee: Ta Triumph Adler Aktiengesellschaft, Nurenberg, Fed. Rep. of Germany

[21] Appl. No.: 280,486

[22] Filed: Dec. 6, 1988

[30] Foreign Application Priority Data

Dec. 7, 1987 [DE] Fed. Rep. of Germany ..... 37413635

[51] Int. Cl.[5] ..... B41J 32/00

[52] U.S. Cl. ..... 400/208; 400/196.1

[58] Field of Search ..... 400/194, 195, 196, 196.1, 400/207, 208, 208.1

[56] References Cited

U.S. PATENT DOCUMENTS

| | | | |
|---|---|---|---|
| 3,918,569 | 11/1975 | Parker | 400/196 |
| 4,130,367 | 12/1978 | Guerrini et al. | 400/195 |
| 4,257,282 | 3/1981 | Wilczewski et al. | 400/196.1 X |
| 4,261,527 | 4/1981 | Sims et al. | 400/196.1 X |
| 4,273,453 | 6/1981 | Haftmann | 400/207 X |
| 4,367,963 | 1/1983 | Daughters | 400/207 X |
| 4,408,914 | 10/1983 | Ciesiel et al. | 400/196 X |
| 4,623,272 | 11/1986 | Kondo | 400/196.1 X |
| 4,624,592 | 11/1986 | Purcell | 400/196.1 X |
| 4,729,676 | 3/1988 | Smith et al. | 400/196.1 |

FOREIGN PATENT DOCUMENTS

| | | | |
|---|---|---|---|
| 0012879 | 12/1979 | European Pat. Off. . | |
| 2161609 | 8/1976 | Fed. Rep. of Germany . | |
| 3546322 | 7/1986 | Fed. Rep. of Germany . | |
| 2170778 | 8/1986 | United Kingdom | 400/208 |

OTHER PUBLICATIONS

IBM Technical Disclosure Bulletin, "Cartridge-Loading Mechanism", vol. 28, No. 2, Jul. 1985, pp. 482–483.

*Primary Examiner*—Ernest T. Wright, Jr.
*Attorney, Agent, or Firm*—Browdy and Neimark

[57] ABSTRACT

A holder for a ribbon for typewriters or similar machines where the holder is insertable into a receptacle. The holder must assume a firm and above all functionally correct connection with the receptacle. For this purpose two sliders with hook-shaped ends are disposed on pivotable side elements of the receptacle. These hooks embrace in their locking position edges provided on the ribbon guide arms. Only when the hooks are in their closed position can the combined device be inserted into the typewriter or the printer. The operationally correct insertion of the combined device would be prevented by a side element which is not closed or a protruding slider with its hook.

2 Claims, 2 Drawing Sheets

HOLDER FOR A RIBBON FOR TYPEWRITERS OR SIMILAR MACHINES

FIELD OF THE INVENTION

The invention relates to a holder for a ribbon for typewriters or similar machines where the holder is insertable into a receptacle. The receptacle has essential operational elements such as, e.g. the ribbon tensioning element, the drive for the stepped movement of the ribbon and a pressure or braking spring. Because of this, the holder for the ribbon can be a one-piece element which, aside from the insertion of the ribbon spools, requires no assembly efforts at all. The holder must be inserted in a fixed way into the receptacle in order to bring the ribbon into the functionally correct position. When both parts are assembled correctly, which in itself does not require any skill, the entire device can be inserted into the typewriter or the printer.

SUMMARY OF THE INVENTION

It is an object of the invention to design the holder and the receptacle in such a way that not only erroneous operation becomes impossible, but that the combined device, comprising the receptacle and the holder for the ribbon, are only insertable into the machine when the holder for the ribbon has been correctly connected with the receptacle. One embodiment of the present invention includes, a slider with a hook disposed on each one of a pivotable side element of the receptacle, which, in its operational position, hooks the holder to the receptacle. On the one hand this provides a fixed but removable connection between the receptacle and the holder for the ribbon. On the other hand the device can only be inserted into the machine after the slider with the hook have connected both parts with each other. It is practical to embody the holder for the ribbon as a cassette. Because of this the ribbon is correctly stored during movement in the course of shipment and the danger of damage averted.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The invention of the present application will now be described in more detail with reference to the preferred embodiments of the device, given only by way of example, and with reference to the accompanying drawings, in which.

DETAILED DESCRIPTION OF THE PREFERRED EMBODIMENT

Figures 1, 3:
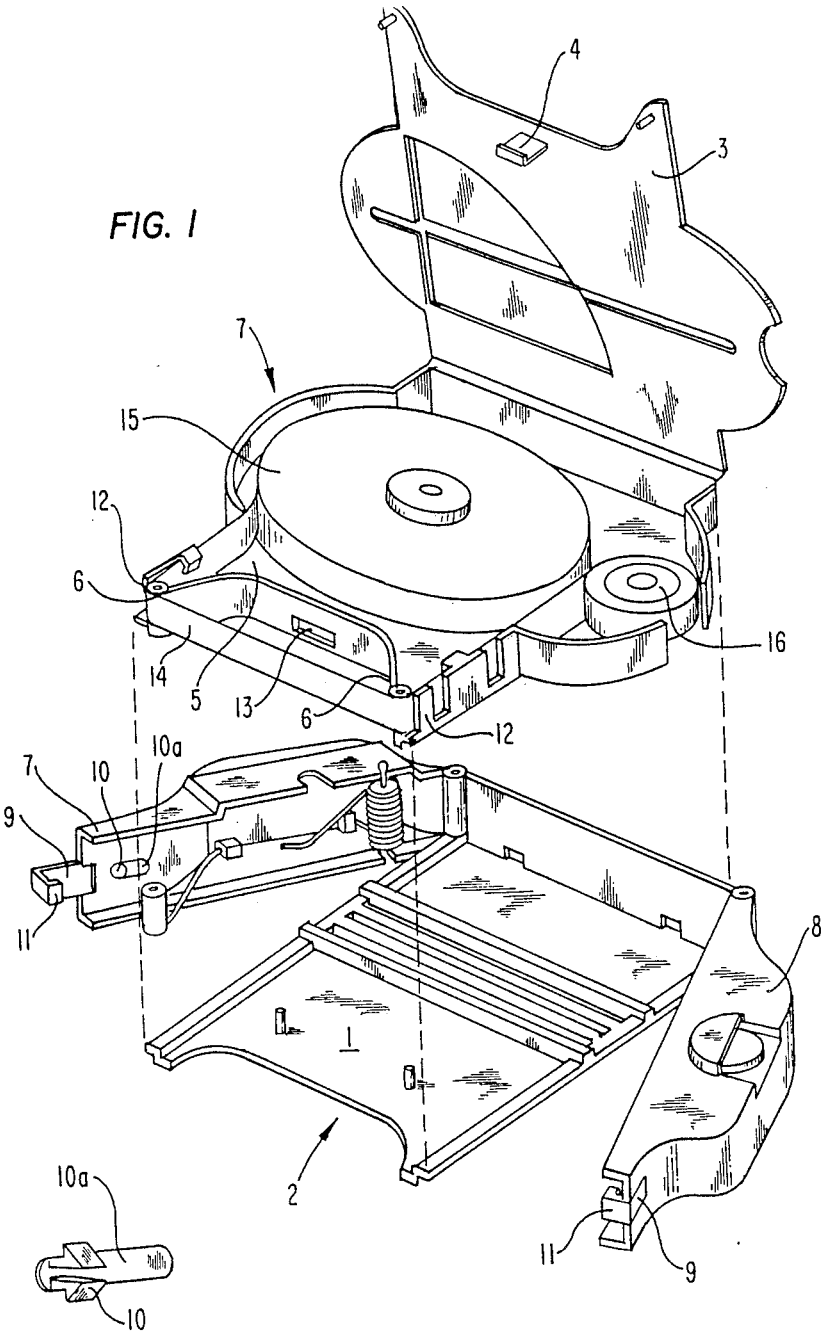
FIG. 1 is a schematic view of the holder with the receptacle in an open and extended view.
FIG. 3 is an enlarged view of the pin 10 and the slit 10*a*.

The holder has been designated with the reference numeral 1 and the receptacle with 2. The holder 1,2 is in the form of a cassette and constitutes a closed unit when the cover 3 has been closed after insertion of the ribbon spools 15,16. To maintain it in the closed position, retaining element 4 may be provided on the cover 3 which extend into a corresponding recess 13 in the base element 5 of the holder 1. The ribbon 14 extends across the front of the holder. The ribbon 14 has been inserted into the holder 1 in such a way that it is exposed between the guide arms 6 and can be drawn along the printing place of the typewriter or printer. The holder 1 with the ribbon 14 and spools 15,16 is offered in trade by the manufacturer of the machine.

Two pivotable side elements 7 and 8 are provided on the receptacle 2 which contain a number of operational elements required for the operation of the device which are not of importance within the scope of this description. Therefore they are not considered in detail here.

A slider 9 is disposed on each one of the pivotable side elements 7 and 8 and is guided by means of a pin slit connection 10, 10*a* in the side elements 7 and 8. The sliders 9,9 have hooks on their front end. These hooks 11 are intended to secure the edges 12 on the ribbon guide arms 6 of the holder 1 in the closed position. In both drawing figures, the respective hook 9 on the pivotable side element 7 has been shown in its respective open position.

Figure 2:
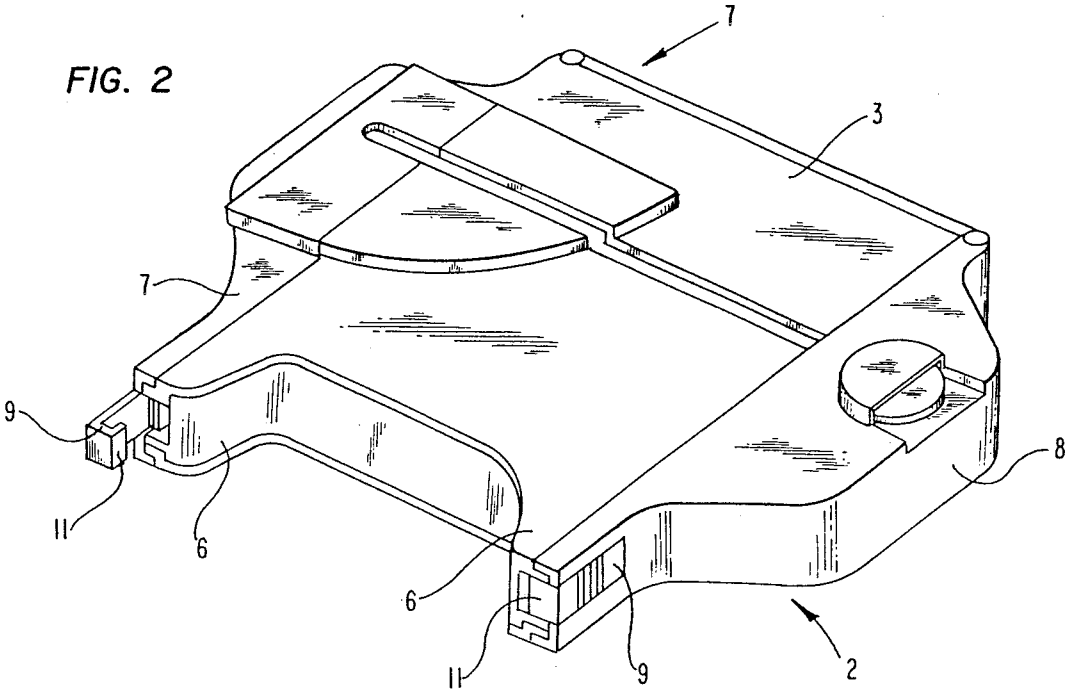
FIG. 2 is the combined device in the closed operational position but enlarged over FIG. 1.

Proceeding from the drawing in FIG. 1 it is assumed that the holder 1 has become operational by the closing of the cover 3. It now must be placed on the receptacle 2. Then the pivotable side element 7 can be pivoted back so that it surrounds the one side of the holder 1 in the form of a shell. Now the slider 9 can be moved back, i.e. in relation to the drawing towards the right, so that the hook 11 embraces the edge 12 on the guide arm 6 of the holder 1 as intended. If, for example, it had been forgotten to move the slider 9 on the pivotable side element 8 forward, the side element 8 cannot be brought into its operational position, since the hook 11 would abut against the side of the guide arm 6 of the holder 1. Therefore the slider 9 must first be moved forward and only then its hook 11 can embrace the edge 12 on the guide arm 6. If, for example and as shown in FIG. 2, it has been forgotten to move the slider 9 on the pivotable side element 7 backwards, this will also be a signal for the operator that the holder 1 and the receptacle 2 are not correctly connected with each other. This might occur, for example, by the hooks 11 protruding in their open position far enough so that the combined device of parts 1 and 2 cannot be inserted into the typewriter of the printer because the hooks 11 are resting, for example, on the card holder or other components located in the vicinity of the printing place. The embodiment may also be such that (as previously described) the combined device is not insertable into the machine if, for example, the pivotable side element 8 has not been pivoted back into its operational position. It can be provided on the machine that the combined device cannot be inserted into it because of its greater width.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A holder for a ribbon for typewriters or similar machines where the holder is insertable into a receptacle, comprising a slider having a hook on a free end thereof, the slider being disposed on each one of two pivotable side elements of the receptacle, and which, in its operational position, hooks the holder to the receptacle.

2. A holder in accordance with claim 1, wherein the holder is in the form of a ribbon cassette.

* * * * *